US007073685B1

(12) United States Patent
Giraud et al.

(10) Patent No.: US 7,073,685 B1
(45) Date of Patent: Jul. 11, 2006

(54) DISPENSER OF OBJECTS

(75) Inventors: Jean-Pierre Giraud, Paris (FR); Roger Nobilet, Torcy (FR)

(73) Assignee: Laboratoires Dolisos, Paris (FR)

( * ) Notice: Subject to any disclaimer, the term of this patent is extended or adjusted under 35 U.S.C. 154(b) by 0 days.

(21) Appl. No.: 09/869,768

(22) PCT Filed: Dec. 30, 1999

(86) PCT No.: PCT/FR99/03317

§ 371 (c)(1),
(2), (4) Date: May 24, 2002

(87) PCT Pub. No.: WO00/40478

PCT Pub. Date: Jul. 13, 2000

(30) Foreign Application Priority Data

Dec. 31, 1998 (FR) ..... 98 16772

(51) Int. Cl.
*B65D 83/00* (2006.01)
*B65G 59/00* (2006.01)
*G07F 11/16* (2006.01)

(52) U.S. Cl. ..... 221/64; 221/65; 221/260; 221/263; 221/267

(58) Field of Classification Search ..... 221/64, 221/65, 260, 267, 268, 270, 263, 264
See application file for complete search history.

(56) References Cited

U.S. PATENT DOCUMENTS 1,889,232 A * 11/1932 Ware ..... 221/64
2,457,345 A * 12/1948 Carline ..... 221/64

FOREIGN PATENT DOCUMENTS

FR 2686579 * 7/1993

* cited by examiner

*Primary Examiner*—David H. Bollinger
(74) *Attorney, Agent, or Firm*—Hueschen and Sage

(57) ABSTRACT

The invention concerns a dispenser of objects comprising a body forming a reservoir (2) for storing objects to be dispensed (8), an outlet passage (22) for said objects, arranged at one end of the body (2), and returned translation means (12) capable of performing a reciprocating movement relatively to the body (2) so as to release a predetermined number of objects (8) at each out and in stroke of the translation movement. The invention is characterized in that said returned translation movement are arranged in the form of a flexible membrane with shape memory (12) perforated with a calibrated opening (17), exerting both a spring force enabling said reciprocating movement and, by co-operation with thrust means (18), to control the dispensing of said objects.

12 Claims, 2 Drawing Sheets

DISPENSER OF OBJECTS

The present invention relates to a dispenser of various objects, and more particularly to a pill dispenser.

The objects which may be dispensed from a storage means have a more or less round or alternatively oblong shape. These various objects are, in particular, pharmaceutical products and, more particularly, pills, capsules, globules, granules, gelatine capsules, tablets, sugar-coated tablets, pastilles and the like. They may also be agri-foodstuff products such as sweeteners or candy. They may alternatively be small items such as screws, nuts, washers, fishing weights or any other cylindrical and/or spherical part or object.

STATE OF THE ART

U.S. Pat. No. 4,230,236 describes a tablet dispenser which comprises a tablet reservoir having, at its base, a dispensing duct with two projecting elements, and a push-button returned by a spring. The dispensing duct is closed by the first element, preventing a tablet from leaving, the second element being inoperative. Depressing the push-button will cause the first element to move, thus opening the duct to cause a tablet to drop, and will cause the second element to move to block the unimpeded release of the next tablet.

FR-2 764 583 describes a packaging tube capable of dispensing granules, comprising a tubular body, returned dispensing means, with an arrangement defining a chute, and a lower receptacle intended to collect the granules. Pressing on the lower receptacle makes it possible to move two tabs belonging to the dispensing means. The first of the tabs opens the base of the chute, to cause the granule engaged therein to fall, and the second closes the top of the chute to prevent the stored granules which follow from passing along the chute.

EP-334 729 describes a dispenser of objects comprising a main hollow body intended to contain the gelatine capsules, and a lower receptacle intended to receive the gelatine capsules leaving the main hollow body. The main body and the lower receptacle each comprise, at their respective base, pivoting moving means capable of opening and closing. Following a downward actuating movement of the main body, the moving means thereof close and, at the same time, the moving means of the lower receptacle open. This allows the object initially stored in the lower receptacle to be dispensed, and makes it possible to prevent the next object from dropping out of the main body. The return movement toward the position of rest causes the lower receptacle to close and causes the main body to open again, which allows the next object to pass into the lower receptacle so that it can be dispensed later.

EP-051 994 discloses a gelatine capsule dispenser which comprises a main hollow body intended to contain the gelatine capsules, and a lower cavity intended to receive the gelatine capsules leaving the main body. The body ends, at its basal end, in an open tube, the diameter of which is markedly greater than the diameter of the gelatine capsules, and in which the gelatine capsules can enter from the hollow body, can then pass along it, and leave toward the bottom, one after another. The lower cavity comprises elastic means. On the one hand, these elastic means extend the open tube and contain a gelatine capsule engaged therein, blocking its passage, and on the other hand, these elastic means can open and close to allow the engaged gelatine capsule to be released. When the user pushes the lower cavity upward, the elastic means deform so as to close the tube to impede the next gelatine capsule, and so as to open the lower cavity, which causes the engaged gelatine capsule to drop out. When the user releases the lower receptacle, the elastic means return to their position of rest.

The aforementioned dispensers all have blocking means which can be opened and then closed alternately delimiting an intermediate storage chamber. They all have the drawbacks of allowing the objects that are to be dispensed from a body that provides storage to drop simply under gravity.

SUMMARY OF THE INVENTION

A first object of the invention is to produce a dispenser which can be actuated manually and which can be adapted to suit all types of object to be delivered. A second object is to design a dispenser which can be used in all attitudes, more particularly lying flat or head down. A further object is to produce a dispenser, the storage reservoir of which remains sealed before the first use. Another object is, for the dispenser, to have use of means providing protection against any inadvertent or unauthorized manipulation.

The problem posed is that of finding a dispenser in which the objects do not leave under gravity. The solution afforded consists in causing the objects that are to be dispensed to be pushed under the action of return means.

A dispenser of objects comprises a body forming a reservoir intended for storing the objects that are to be dispensed, an outlet passage for the objects to be dispensed, arranged at one of the ends of the body, and returned translation means capable of performing a reciprocating movement with respect to the body so as to release a determined number of objects during each outward and return stroke of the translational movement.

According to the invention, the dispenser is characterized in that said returned translation means are arranged in the form of a flexible shape-memory membrane pierced with a calibrated opening, making it possible both to exert the return force that allows said reciprocating translational movement and, by cooperating with thrust means to control and dispense said objects.

According to a first aspect of the invention, the pushing means comprise a fixed element situated toward the end of the outlet passage near where the object or objects to be dispensed lie, the returned translation means moving alternately closer to and away from the fixed element, so that the fixed element pushes said object or objects to be dispensed out of the outlet passage, toward the outside of the dispenser, for each movement of the translation means. These pushing means make it possible to reduce the height of the space between the fixed element of the hollow body and the translation means.

According to a second aspect of the invention, the returned translation means comprise a returned member with an elastically deformable elastomer membrane pierced with a centered opening through which the object or objects to be dispensed can leave. The fixed element is a centered elongate piece secured to the end of the body and placed more or less facing the opening in the returned member, and with a chamfered face and cut to a point so that it is tailored to the shape of the object to be dispensed.

According to another aspect of the invention, the dispenser may have a cap which acts as an object receptacle. The cap slides with respect to the body and may actuate the translation means by pressing against, pushing and elastically deforming the deformable membrane toward the fixed element.

According to yet another aspect of the invention, the dispenser may comprise a removable safety device intended to prevent access to the translation means and any movement thereof.

Other advantages according to the invention will become apparent upon reading the detailed description of the invention, referring to the drawings which are given by way of illustration and in which.

DETAILED DESCRIPTION OF THE INVENTION

Figure 1:
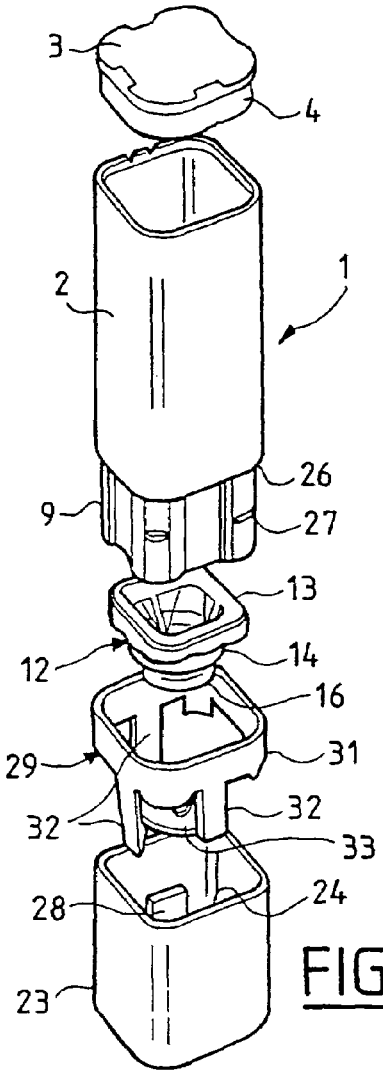
FIG. 1 depicts a perspective view of the various constituent parts of an object dispenser, ready to be assembled.
Figure 2:
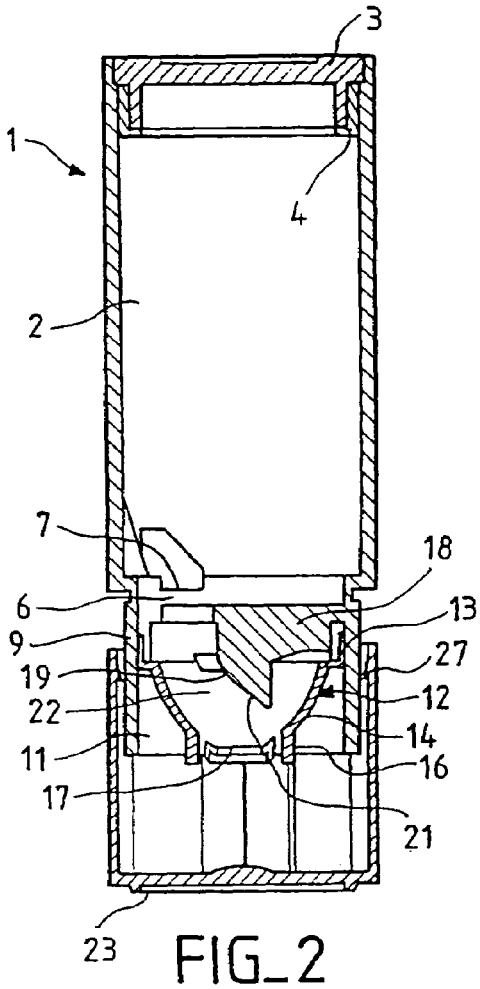
FIG. 2 depicts a view in longitudinal section of the object dispenser.
Figure 3:
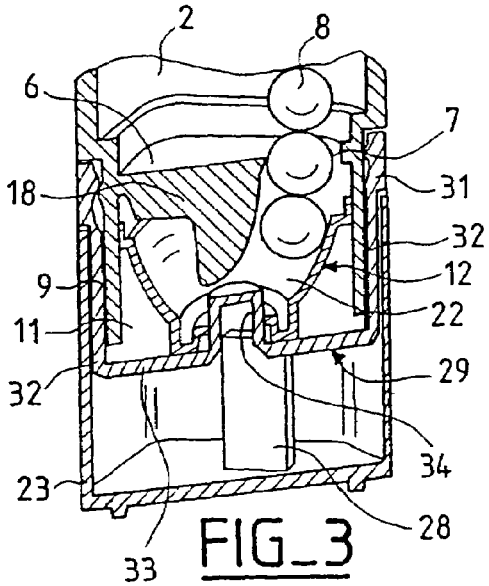
FIG. 3 depicts an exploded view in longitudinal part section of the functional lower part of a pill dispenser, with the safety device fitted.
Figure 4:
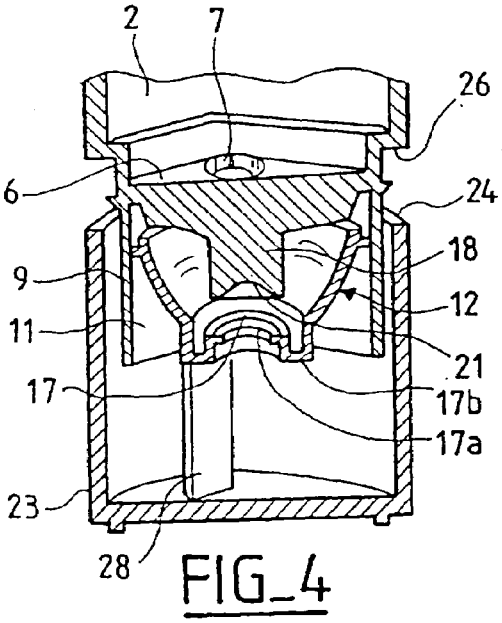
FIG. 4 depicts an exploded longitudinal part section viewed from a different angle, of the functional lower part of the pill dispenser.
Figure 5:
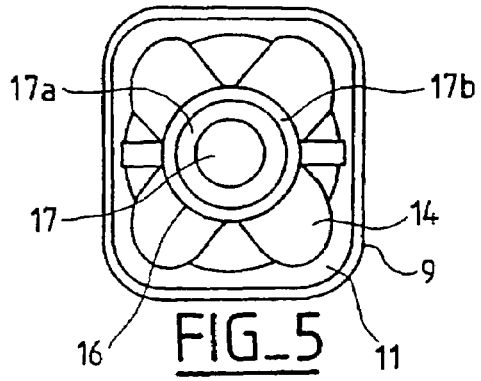
FIG. 5 depicts a view from underneath of the functional lower part of the pill dispenser.
Figure 6:
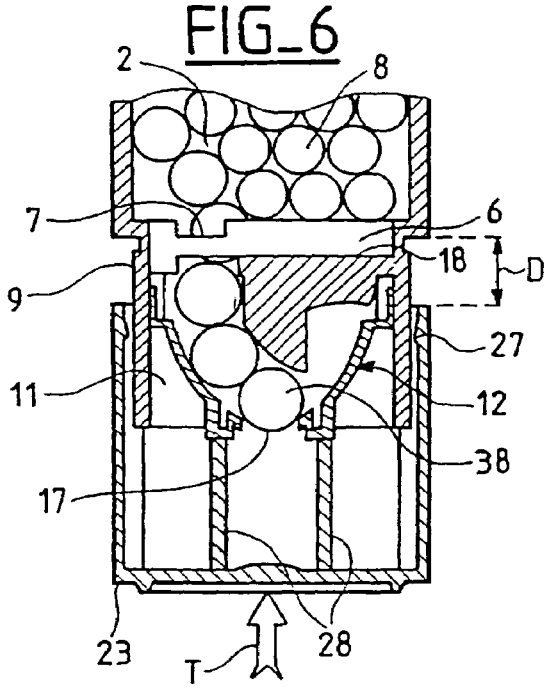
FIG. 6 depicts a view in longitudinal section of the functional lower part of the pill dispenser, with a pill ready to be dispensed.
Figure 7:
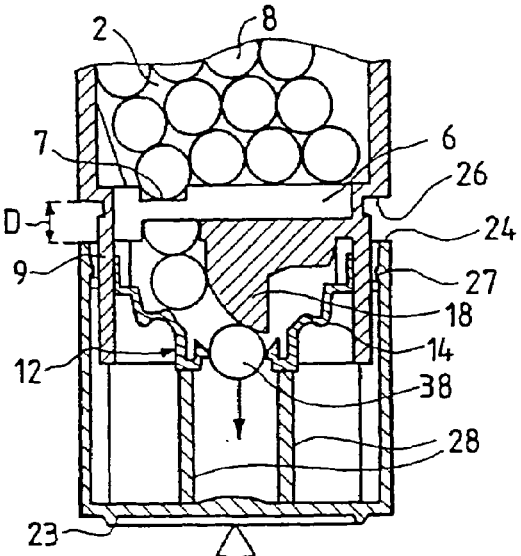
FIG. 7 depicts a view in longitudinal section of the functional lower part of the pill dispenser, with a pill in the process of being dispensed.
Figure 9:
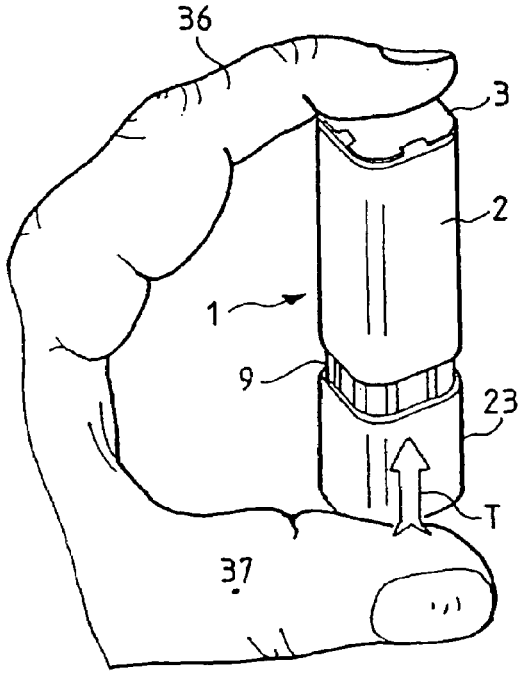
FIG. 9 depicts a view of a use of the object dispenser.
Figure 8:
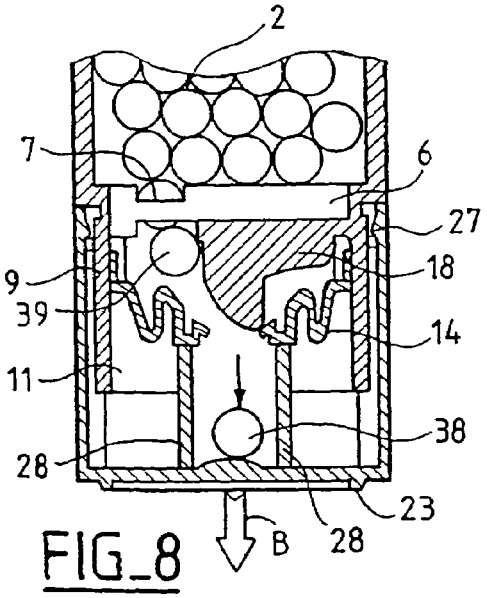
FIG. 8 depicts a view in longitudinal section of the functional lower part of the pill dispenser after dispensing, with a dispensed pill.

A dispenser of objects 1 comprises a hollow body forming a reservoir 2 intended for storing the objects that are to be dispensed, and more particularly, in one of the embodiments of the invention, granules for homeopathy. The body 2 is of elongate parallelepipedal type, with a square cross section and rounded longitudinal edges. This gives the dispenser 1 an elongate overall shape. The body 2 is made of opaque polypropylene, or any other rigid thermoplastic polymer. The body 2 is closed at its upper end by an upper plug 3. The dispenser 1 is filled with granules during a filling phase at the factory, before the plug 3 is sealed in place. Given that the dispenser 1 can be used for delivering pharmaceutical products that may be sensitive to moisture, to oxygen and to other forms of attack also, the plug 3 is preferably fitted with a seal 4. This seal 4 is an overmolding of a rubber or elastomer material based on the periphery of the plug 3.

The body 2 is closed toward its lower part by a transverse wall 6. This then defines an upper part in which to keep the granules, and a functional lower part which will comprise all the means used for dispensing said granules. Formed in the transverse wall 6 is a passage orifice 7 for letting out the granules. The orifice 7 is off-centered with respect to the body 2, and is preferably pierced in one of the corners. The diameter of the orifice 7 is very slightly greater than the diameter of a granule 8 that is to be delivered. This allows granules 8 which are stacked up one after the other to be let out of the body 2 smoothly, one by one.

Starting from the transverse wall 6, the body 2 comprises the functional lower part 9, which is in the form of a thinning of the body. The orifice 7 of the upper part of the body 2 opens into an interior zone 11 defined by the wall of the functional part 9.

Returned translation means capable of effecting a reciprocating movement with respect to the body are inserted in the interior zone 11. These means are in the form of a cup-shaped membrane 12. The pole of the more or less hemispherical membrane 12 points downward and toward the outside of the zone 11, that is to say away from the transverse wall 6. The membrane 12 can itself be broken down into three segments.

A first segment 13 allows the entire membrane 12 to be secured to the end of the interior zone 11 of the functional part 9, against the transverse wall 6. The first segment 13 has a square transverse cross section so that it perfectly matches the square cross section of the interior zone 11. The first segment is rigid or alternatively itself has a small rigid surround, its edge being fixed to the wall 6 at the end of the body.

A second segment 14 has a rounded dome shape in transverse section and has a round cross section. The second segment 14 is made of a shape-memory elastic material, for example an elastomeric material. The second segment 14 can deform axially. This second segment 14 means that the membrane behaves like a returned part.

A terminal third segment 16 constitutes the pole of the membrane 12. The third segment may have a cylindrical shape. Formed in the third segment 16 is a polar opening 17 centered simultaneously with respect to the axis of the cup, with respect to the interior zone 11, and thus with respect to the body 2. The opening 17 is round. It is through this opening 17 that the granules are ejected. If the granule to be dispensed is in the form of a ball, then the opening 17 has a diameter slightly smaller than the diameter of the granule 8.

The opening 17 has a round and flexible lip 17*a*. At rest, the lip 17*a* holds a granule, and in operation, the lip 17*a* deforms so as to cause the granule to pass through the opening 17. The lip 17*a* is itself surrounded by a rigid and more or less flat periphery 17*b*, intended to guide the granule. The lip 17*a* of the opening 17 may also be surrounded by an additional rigid ring made of polypropylene or any other thermoplastic polymer fixed to the end of the third segment 16.

The transverse wall 6 has a fixed element or protrusion 18 projecting downward. This is an elongate part secured to the end of the body, oriented toward the interior zone 11 of the functional part 9 of the body 2 and more particularly, directed more or less toward the opening 17.

The protrusion 18 is positioned in the hollow part defined by the membrane 12. The protrusion 18 is centered with respect to the wall 6, and therefore with respect to the end of the body, and placed facing the opening 17 in the returned membrane. The base of the protrusion 18 is contiguous with the edge of the orifice 7. Starting from the orifice 7, and extending as far as its end, the protrusion 18 has a chamfered face 19. The end of the protrusion 18 is also cut to a point, so as to give a concavity 21 tailored to the shape and size of the granules 8.

The cavity or hollow part, with the interior surface of the membrane 12 and the chamfered face 19 of the protrusion 18 delimit a passage 22 for the granules that are to be dispensed, beginning at the orifice 7 of the body 2 and ending at the opening 17 in the membrane 12. The width of the passage 22 is very slightly greater than the diameter of a granule 8, so that the granules can run unimpeded one behind the next. At rest, the granules roll along the passage 22 and are stopped by the concavity 21 and by the lip 17*a* of the opening 17.

The granule dispenser 1 also comprises a hollow lower cap 23, intended to close the lower part with its interior zone 11, and intended to protect the membrane 12. The cap 23 is of parallelepipedal type with a square cross section equal to that of the body 2. The thinning of the functional lower part 9 of the body fits into the cap 23, the latter then being placed toward the bottom. The cap can freely slide in a longitudinal direction telescopically on the thinned part of the functional part 9, until the edge face of the four walls 24 comes into abutment against a step 26 obtained by the thinned portion.

Fine shoulders 27, positioned both on the outer wall of the thinned portion of the functional part 9 and on the interior walls of the cap 23, are locked together, preventing complete withdrawal of the cap 23. The step 26 and the shoulders 27 make it possible to define the sliding travel D of the cap 23.

The cap 23 has at least one interior rectangular tongue 28, fixed to the bottom, projecting into the cap 23. The tongue 28 is arranged in such a way that it is positioned exactly under the third segment 16 of the membrane 12, and that it is capable of touching the periphery of the opening 17. In the case of a granules dispenser, use is made of two tongues 28 fixed symmetrically with respect to each other. The tongues press against the third segment 16, then, during longitudinal sliding, are intended to squash the membrane 12 so as to release a determined number of objects during each outward and return stroke of the sliding movement. Advantageously, the cap acts as a receptacle for one or more granules. The cap may be made of a rigid and transparent thermoplastic polymer so that the user can see and possibly count the granules.

The granules dispenser also comprises a removable protection and safety device 29. The device 29 itself constitutes a ring of square cross section 31. The ring 31 can be inserted in the thinned portion of the functional part 9 up to the step 26. The ring 31 has a height more or less equal to the maximum permitted travel D for the sliding of the cap 23. With the ring fitted, the cap 23 can no longer slide and can no longer squash the membrane 12. The ring also makes it possible to avoid inadvertent telescopic movement when the cap 23 is being forced on.

The device 29 also consists of at least one longitudinal extension 32 fixed to the ring 31. The extension 32 serves to secure a centered disk 33, equipped with a central pip 34. The disk 33 serves to prevent any access to and any movement of the membrane 12. The tongues 28 of the cap 23 will bear against the disk 33 rather than against the third segment 16 of the membrane 12, the disk 33 transmitting the bearing force to the ring via the extension 32. This constitutes an additional safety feature to prevent the membrane 12 from being squashed.

The pip 34 positions itself in the opening 17 and plugs it. This makes it possible to keep the passage 22 and the reservoir with its granules sheltered from moisture, oxygen and other forms of attack. The protective device 29 guarantees against tampering, because it is mounted from the outset between the body 2 and the cap 23. In addition, when put back in place after each use, the device 29 will provide a safety feature against children, known as "child-proofing".

Use of the Granules Dispenser

The user removes the cap 23, removes the protective device 29, and refits the cap 23. Next, the user places the dispenser 1, for example with the plug 3 uppermost, in the region of his index finger 36 and the cap 23 downmost, in the region of his thumb 37.

At rest, a granule 38 automatically positions itself under the protrusion 18 and, precisely, in the region of the concavity 21 and above the opening 17. As the diameter of the opening 17 is appreciably smaller than the diameter of the granule 38, the latter will not drop into the receptacle cap 23 under the effect of gravity.

The user then exerts pressure T upward, so as to cause the cap 23 to slide along the thinned portion of the functional part 9. The gradual upward travel of the cap 23 means that the tongues 28 begin to push the third segment 16 of the membrane 12 toward the fixed protrusion. The flexible second segment 14 begins to bend into an S-shape (when viewed in transverse cross section). Through this gradual longitudinal movement of the cap 23, the tongues 28 placed at the bottom of the cap 23 reversibly squash and deform the flexible membrane 12 upward. The shape of the third segment 16 with its rigid periphery 17*b* will not change. The distance D between the edge 24 of the cap and the shoulder 26 becomes ever smaller. The pressure T stops when the edge 24 of the cap touches the shoulder 26.

Thus, the protrusion 18 with its concavity 21 will gradually push the granule 38 through the opening 17 in the membrane. The size of the space available between the tip of the central protrusion 18 and the membrane 12 becomes ever smaller, the protrusion 18 pushing the granule that is to be dispensed out of the passage 22, through the opening 17, toward the outside of the dispenser 1. Because of the respective diameters of the granule 38 and of the opening 17, the granule 38 will be pushed forcibly through the opening, deforming the lip 17*a* and will be expelled downward, toward the receptacle cap 23.

When the user releases his pressure T, and because of its shape memory, the elastic second segment 14 reverts to its original shape. The cap 23 returns downward B toward its original position, the flexible membrane 12 returning to its initial shape. The responsiveness of the return B depends on the thickness and on the elastic modulus of the elastomeric material used. The space between the central protrusion 18 and the membrane 12 returns to its original size, which allows another granule 39 which follows, to slip through the granules passage 22 and position itself above the opening 17 in the membrane 12.

The dispenser can therefore be immediately used again to eject the next granule 39. A predetermined number of granules may be ejected for each upward stroke of the cap 23 followed by a return, the returned translation means moving alternately toward and away from the fixed protrusion.

The dispenser according to the invention is not restricted by the details of the embodiments and examples chosen for illustrating it. For example, the shapes and dimensions of the orifice 7, of the protrusion 18, of the returned membrane 12, of the passage 22 and of the opening 17 need merely be adapted to suit each new use and each type of object to be dispensed. The body 2 may also have a different shape. Modifications can be made without in any way departing from the scope of the invention. The latter therefore encompasses all means constituting technical equivalents of the means described, and the combination thereof.

The invention claimed is:

1. A dispenser of objects comprising a body (1) forming a reservoir (2) for storing objects (8) to be dispensed, an outlet passage (22) for said objects arranged at an end of the reservoir (2) to pass said objects to a returned translation means, which has an opening (17), and is comprised of a deformable elastomer membrane (12) for performing a reciprocating movement with respect to the reservoir (2), wherein the elastomer membrane is operationally deformed to move objects (8) positioned in the elastomer membrane toward a protrusion (18), whereby the protrusion (18) is forcibly contacted with the objects (8) to expel a determined number of objects (8) through the opening (17) to a receptacle (23) with each outward and return stroke of translational movement.

2. The dispenser according to claim 1, wherein the protrusion (18) comprises a fixed element situated adjacent to the outlet passage (22) near where the object or objects (8) to be dispensed lie, and in proximity to the deformable elastomer membrane (12).

3. The dispenser according to claim 2, wherein the fixed element is an elongate piece secured to the end of the body (1) and is placed facing the opening (17) in the deformable elastomer membrane (12).

4. The dispenser according to claim 3, wherein the fixed element has a chamfered face (19) and a cut end to impart a concavity (21) tailored to the shape and size of the object to be dispensed.

5. The dispenser according to claim 2, wherein the fixed element and the opening (17) in the deformable elastomer membrane (12) are arranged centrally with respect to the end of the reservoir (2).

6. The dispenser according to claim 2, wherein the outlet passage (22) for said objects is defined by the interior face of the deformable elastomer membrane (12) and by the exterior surface (19) of the fixed element.

7. The dispenser according to claim 1, wherein the opening (17) has a diameter slightly smaller than the diameter of the object (8), and wherein the opening (17) comprises a flexible lip (17*a*) to allow the object to pass.

8. The dispenser according to claim 1, wherein the deformable elastomer membrane (12) is in the form of a flexible cup, the edge of which is fixed to the end of the reservoir (2).

9. The dispenser according to claim 1, wherein the receptacle (23) receives the dispensed determined number of objects (8), and also functions as a cap.

10. The dispenser according to claim 1, wherein the receptacle (23) slides with respect to the reservoir (2) and has one or more internal projections (28) which press against to push and elastically deform the deformable elastomer membrane (12) toward the protrusion (18).

11. The dispenser according to claim 1, further comprising a removable safety device (29), to prevent access to the deformable elastomer membrane and to prevent any movement of said the deformable elastomer membrane (12).

12. The dispenser according to claim 1, which dispenses pills, tablets or sweeteners.

* * * * *